US006394098B1

(12) United States Patent
Cunningham

(10) Patent No.: US 6,394,098 B1
(45) Date of Patent: May 28, 2002

(54) METHOD AND APPARATUS FOR PROCESSING TOBACCO

(75) Inventor: William Cunningham, Bristol (GB)

(73) Assignee: Imperial Tobacco Limited (GB)

( * ) Notice: Subject to any disclaimer, the term of this patent is extended or adjusted under 35 U.S.C. 154(b) by 0 days.

(21) Appl. No.: 09/319,985

(22) PCT Filed: Dec. 12, 1997

(86) PCT No.: PCT/GB97/03430

§ 371 (c)(1),
(2), (4) Date: Sep. 14, 1999

(87) PCT Pub. No.: WO98/26676

PCT Pub. Date: Jun. 25, 1998

(30) Foreign Application Priority Data

Dec. 17, 1996 (EP) ..... 96309188

(51) Int. Cl.[7] ..... A24B 5/10; A24B 5/00
(52) U.S. Cl. ..... 131/312; 131/314; 131/311
(58) Field of Search ..... 131/311, 312, 131/313, 314; 241/154, 159, 189.1, 227

(56) References Cited

U.S. PATENT DOCUMENTS 2,687,439 A * 12/1954 Davis ..... 131/312
2,789,564 A * 4/1957 Hunter ..... 131/145
3,238,952 A * 3/1966 Ashworth et al. ..... 131/312

FOREIGN PATENT DOCUMENTS

| | | | |
|---|---|---|---|
| EP | 112040 | * | 6/1984 |
| GB | 1396931 | * | 6/1975 |
| WO | WO 90/05034 | * | 5/1990 |

* cited by examiner

*Primary Examiner*—Stanley S. Silverman
*Assistant Examiner*—Dianne A. Walls
(74) *Attorney, Agent, or Firm*—Larson & Taylor, PLC

(57) ABSTRACT

A method and apparatus for processing tobacco, in which tobacco leaves are threshed to form a mixture of free lamina, clean stem pieces from which lamina has been completely or substantially completely removed and uncleaned stem pieces which have useful pieces of lamina attached thereto. This mixture is sifted to separate the clean stem pieces from the unclean stem pieces. The unclean stem pieces are subjected to additional threshing by recycling the unclean stem pieces to the thresher. A sieve may be used to carry out the method and as a part of the apparatus.

11 Claims, 8 Drawing Sheets

METHOD AND APPARATUS FOR PROCESSING TOBACCO

This invention relates to a method and an apparatus for processing tobacco.

In the tobacco industry, it is well-known that in order to process the tobacco into a suitable form for use in the manufacturing of products, the tobacco leaf has to have the midrib stem removed from the rest of the tobacco leaf (hereinafter referred to as the lamina). This process is generally referred to as threshing.

In the current art, the most common leaf threshing process consists of:

1. Feeding the tobacco leaves into the top of a threshing mill. The leaves are broken up by the action of a rotating element, with radially protruding teeth, until they are small enough to pass through a fixed screen at the bottom of the mill.
2. The threshed leaf is then classified using an air flow in a vertical tower. The lighter, stem free, material rises with the air flow and is removed from the threshing process. The heavier, stem-containing material drops, under the influence of gravity, down the tower, through the air.
3. This heavy, stem containing, material is passed to a second threshing mill, and the process is repeated.

The overall process usually has between four and six stages of threshing and classifying before all the lamina is removed from the midrib stem.

At each stage the aperture size of the screen at the bottom of the mill reduces.

This process is illustrated by means of the flow diagram in FIG. 1.

It can be observed from this description that it is not possible to reduce the number of threshing stages in use in a process of this form by using a recycle system. The heavy stems would have no means of escaping from the recycle and would accumulate in the process, rapidly overloading it.

GB 740088, U.S. Pat. No. 2,697,439, U.S. Pat. No. 3,046,998 and U.S. Pat. No. 3,513,858 each describe methods of recycling heavy stems with lamina still attached. in each of the processes, an air classification system is used to separate the tobacco into three streams i.e., lamina, clean stems and stems with lamina still attached. The three stream air classification systems are relatively complicated.

U.S. Pat. No. 3,661,159 describes apparatus for stemming tobacco leaves which separates the threshed leaves into light and heavy fractions.

Classification of threshed tobacco leaves into light and heavy fractions is also disclosed in EP-A-0707800, GB-A-2157411 and WO90/05034. The apparatus mentioned in WO90/05034 includes a sieve to separate out the largest size particles after threshing but deals only with improvements in classification systems.

The present invention solves the problem of allowing the use of a recycle system in the processing of tobacco leaves without the need for a complicated three stream air classification system.

According to the present invention, there is provided a method for processing tobacco comprising threshing tobacco leaves in a thresher to form a mixture of free lamina, clean stem pieces from which lamina has been completely or substantially completely removed and unclean stem pieces which have useful pieces of lamina attached thereto, sifting to separate the clean stem pieces from the unclean stem pieces and subjecting the unclean stem pieces to further threshing by recycling the unclean stem pieces to the thresher. The unclean stem pieces are recycled to the same thresher in which they were first produced by threshing tobacco leaves.

The separation of the clean stem pieces from the unclean stem pieces may be carried out at any stage after the threshing step e.g., before or after the conventional separation (or classification) of the lamina from the stem-containing material.

Therefore, in one preferred embodiment, the free lamina is removed from the mixture before sifting. The term sifting is used synonymously with the term sieving in this specification.

In another preferred embodiment, the mixture of lamina, clean stem pieces and unclean stem pieces is sifted to separate the clean stem pieces, and the free lamina is then removed from the unclean stem pieces which are later subjected to additional threshing.

The threshing of the tobacco leaves may be carried out by conventional methods well-known in the art. Sifting of the threshed tobacco may be carried out separately from the threshing step. Alternatively, threshing and sifting may be carried out together in a single piece of apparatus. Such an apparatus for threshing and sifting is described in our related European patent application no. 96309198.8 which is entitled "Apparatus and Process for Threshing Tobacco" and has the same filing date as this application.

Preferably, the free lamina is removed from the mixture or the unclean stem pieces by air classification which is a conventional technique well-known to those skilled in the art.

Sifting to separate the clean stem pieces from the unclean stem pieces (either mixed with or without free lamina pieces) is carried out by the use of a sieve or a similar device. The sieve can be of any type known within the art. Preferably it is a cascade type or rotary type with wiped sides, which are less prone to malfunctioning as a result of screen blocking. The screen size used in the sieve will depend on the size and type of leaves being processed, but commonly the aperture size in the screen will be between 10 and 100 mm.

The type of screen used in the sieve can be of any type known within the art.

The tobacco entering the process may optionally be cut into sections across the stem before threshing, usually referred to as tipping or butting, and the unclean stems may be cut into shorter lengths prior to being threshed with unthreshed tobacco leaves. The shorter stem length improves the sieving of the clean stems after they have been threshed.

The invention also provides apparatus for processing tobacco comprising threshing means for threshing tobacco leaves to form a mixture of free lamina, clean stem pieces from which lamina has been completely or substantially completely removed and unclean stem pieces which have useful pieces of lamina attached thereto, wherein the apparatus further comprises means for sifting to separate the clean stem pieces from the unclean stem pieces and means for returning the sifted unclean stem pieces back to the threshing means. The means for sifting is preferably a sieve. The means for returning the sifted unclean stem pieces back to the threshing means may comprise a conventional conveying device such as a conveyor belt.

By the term clean stem pieces, it is meant that the stem pieces are not attached to useful pieces of lamina i.e., pieces of lamina which could be relatively readily separated from the stem in a threshing process. Similarly, the term unclean stem pieces refers to pieces of stem which do have useful pieces of lamina attached.

The nature of the clean stem pieces will depend upon the aperture size of the screen used in the sieve. Where the aperture size is low, the amount of lamina attached to the stems passing through the screen will be small, typically less than 1% of the total lamina entering the process. Where the aperture size is large, the amount of lamina attached to the stems passing through the screen will be greater, up to 20% of the total lamina entering the process, but is preferably not more than 10% of the total lamina entering the process.

Where the stems produced are clean or contain a very small amount of attached lamina, they can be removed from the threshing process and passed without further processing to a drying stage or other process.

Where the amount of lamina still attached to the stems is greater or where totally clean stems are required for drying or further processing they can be passed first to a final polishing process. The final polishing process can consist of any type of suitable threshing process known within the art. Preferably it consists of a single conventional thresher and classifier or a further single conventional thresher, classifier and sieve with a small aperture screen as described in this application, or carried out using the apparatus described in our related application no. 96309198.8.

The unclean stems i.e., the stems which are still attached to relatively large pieces of lamina, can be recycled to any of the previous threshing stages.

The main advantages of the present invention are as follows:

1) The number of unit processes in a threshing plant can be reduced.
2) The average size of lamina produced from the process is larger.
3) Less stem fibres and dust are produced in the process.

The first of these advantages arises from the recycle process using the preferred apparatus of the invention where over 90% of the lamina can be removed in the first threshing stage, compared to less than 70% in a conventional single pass process.

The second of these advantages results from the fact that the invention allows recycling of the stems with large pieces of lamina attached, into a thresher with a large aperture screen at the bottom of the mill. The large pieces of lamina which are freed from the stems do not then have to be broken further in order to escape through the screen.

The third of the benefits arises from the effect of the process in reducing the number of times that the stems have to pass through a thresher. The majority of stems will pass through a thresher only twice, or three times where a final polishing stage is used, instead of the four to six times the stems pass through a thresher in a conventional threshing process.

The threshing means and means for sifting are preferably provided in a single combined threshing and sifting device, as disclosed in European patent application no. 96309198.8. The device comprises rotatable stripping means and a feeder comprising a pair of co-operating counter-rotatable elements for delivering tobacco leaves to the stripping means, the feeder and the stripping means being arranged such that, in use, the tobacco leaves experience shearing forces as they pass from between the counter-rotating elements to the rotating stripping means which forces at least partially strip the lamina from the stem.

The stripping means preferably comprises radially extending arms. The arms may be in the form of continuous plates or spaced teeth (which can be straight, bent or curved) and may include parts which are capable of cutting the tobacco leaves or are capable of puncturing the leaf and tearing through the leaf.

The elements also preferably comprise radially extending arms which also may be in the form of straight, curved or bent continuous plates or spaced teeth, optionally including parts which are capable of cutting the tobacco leaves. Alternatively, the feeder elements may comprise a pair of rollers or may consist of a flexible membrane wrapped around a framework which allows variable quantities of leaf to be fed.

The arms may be flexible, inflexible or a mixture of fixed and flexible components.

The rotating elements and the stripping means can take the same form and may be the same shape and size, differing only in their function which is dictated by their position in the device.

The stripping means and the feeder are arranged at a relatively close distance from each other in order to subject the tobacco to the shearing forces which at least partially strip the lamina from the stem. Preferably, the distance between the outermost parts of the two elements in the feeder is less than 150 mm and the distance between the outermost parts of each of these elements and the outermost part of the stripping means is less than 100 mm. The shearing forces are experienced by the tobacco leaves as they are directed from the feeder to the rotating stripping means. The tobacco leaves are preferably delivered to the rotating stripping means substantially along a radius of the axis of rotation of the stripping means. The lamina is stripped from the stem in the region where the leaves pass from being moved under the influence of the feeder to being moved by the stripping means and, as the skilled person will appreciate, the exact position of this region will vary depending upon the particular configuration of the device and the rate of rotation of its various rotating components. The shearing force can be considered, at least in certain circumstances, as arising from the action of the stripping means on one part of the leaf while the feeder is holding another part of the leaf.

Preferably, where the arms of the stripping means and those of the elements consist of spaced teeth, the teeth are intermeshed. With such an arrangement, the stripping of the lamina from the stem is effected, to some extent, by the interaction of the stripping means and the feeder. When the teeth are intermeshed, the distance between the teeth as they pass each other is typically less than 100 mm.

The device preferably comprises a rotatable drum in which the stripping means and the feeder are arranged. The drum comprises a screen (e.g., in its walls) which allows the clean stem pieces to be sieved and to pass out of the drum. The screen can form all or only part of the side walls of the drum.

The drum preferably incorporates internally protruding lugs for directing the tobacco leaves to the feeder elements. As the drum rotates, the lugs collect the tobacco leaves so that the leaves travel around the inside of the drum until they fall (preferably solely under the influence of gravity) into the feeder. The positioning of the feeder within the drum and/or the speed of rotation of the drum are adjusted so as to ensure that a suitable amount of the tobacco leaves is delivered to the feeder as the drum rotates.

The stripping means and the elements preferably rotate about axes which are parallel to the axis of rotation of the drum. Preferably, the axes of rotation are either substantially horizontal or are tilted at from 0 to 10° (more preferably 2° to 6°) to the horizontal.

The device can comprise more than one (e.g., two) stripping means and the extra stripping means can be provided by one or more additional rotating elements. These additional elements may carry out a degree of threshing and/or cutting of the tobacco leaves and they may participate in the delivery of the partially threshed or unthreshed leaves to the feeder and/or the stripping means. The device may also comprise additional rotating elements which act solely to direct leaf material into the stripping means.

The stripping means and elements can converge as they approach the exit end of the drum to take account of reduced loading resulting from the small particles being sieved out of the main flow. This also allows the amount of threshing that takes place to increase towards the exit end of the drum. This convergence can be achieved by varying the diameter of the stripping means and/or the elements along their length. By adopting this method, an additional effect will be to increase the tangential velocity of the arm tips as the diameter increases and this will affect the threshing characteristics.

The diameters of the stripping means and the elements (as defined by the end of any radially protruding arms) are typically from 5 to 50% of the diameter of the drum.

The tangential velocity of the drum is preferably in the range of from 0.04 to 0.5 m/s with the tangential velocity of the stripping means and the elements being from 3 to 250 times (preferably 10 to 100 times) greater than that of the drum.

The rotating components of the device (other than the drum) can be run at synchronous speeds to achieve true intermeshing of the stripping means and the rotating elements. Alternatively, the rotating components can be run such that they have different tangential velocities, thus setting up shear actions between the various rotating components. The choice of rotational speed and mode of operation depend upon the design of the rotating component and drum protrusions used and this in turn depends on the nature of the leaves being threshed and upon the required specification of the threshed material.

The invention will now be described, by way of example only, with reference to the accompanying drawings wherein.

Figure 1:
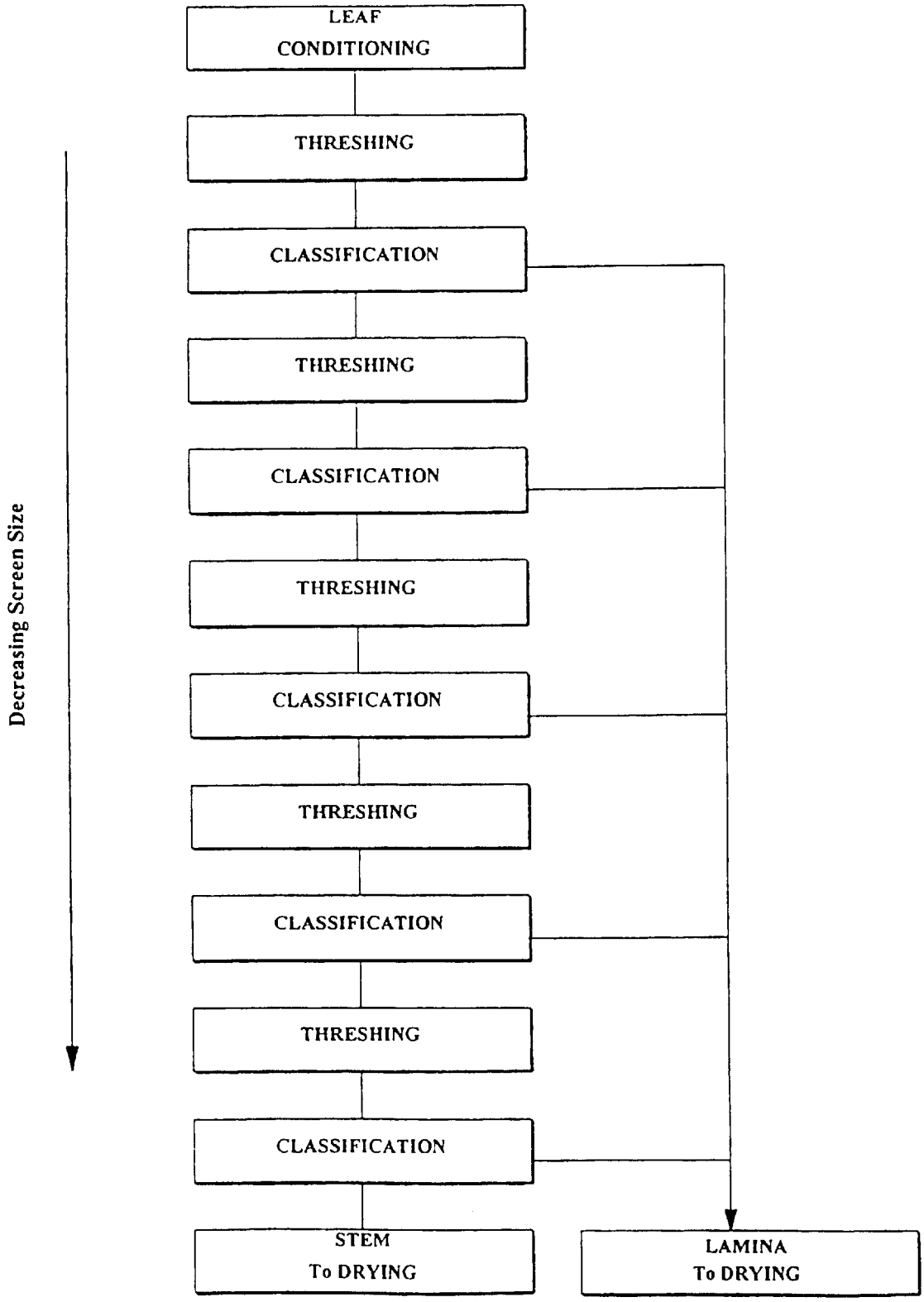
FIG. 1 PRIOR ART
FIG. 1 is a flow diagram showing a conventional threshing process.

Referring to FIG. 1, tobacco leaves are conditioned and subjected to a series of alternate threshing and classifying steps. The process shown in FIG. 1 has five threshing and classification steps, each of the separation steps after the first being carried out in a threshing mill with a smaller aperture in the screen at the bottom of the mill than that in the previous threshing stage. The free lamina obtained from the separation step is collected for drying or further processing. The stem material which remains after the final classification step will also be sent for drying or further processing.

Figure 2:
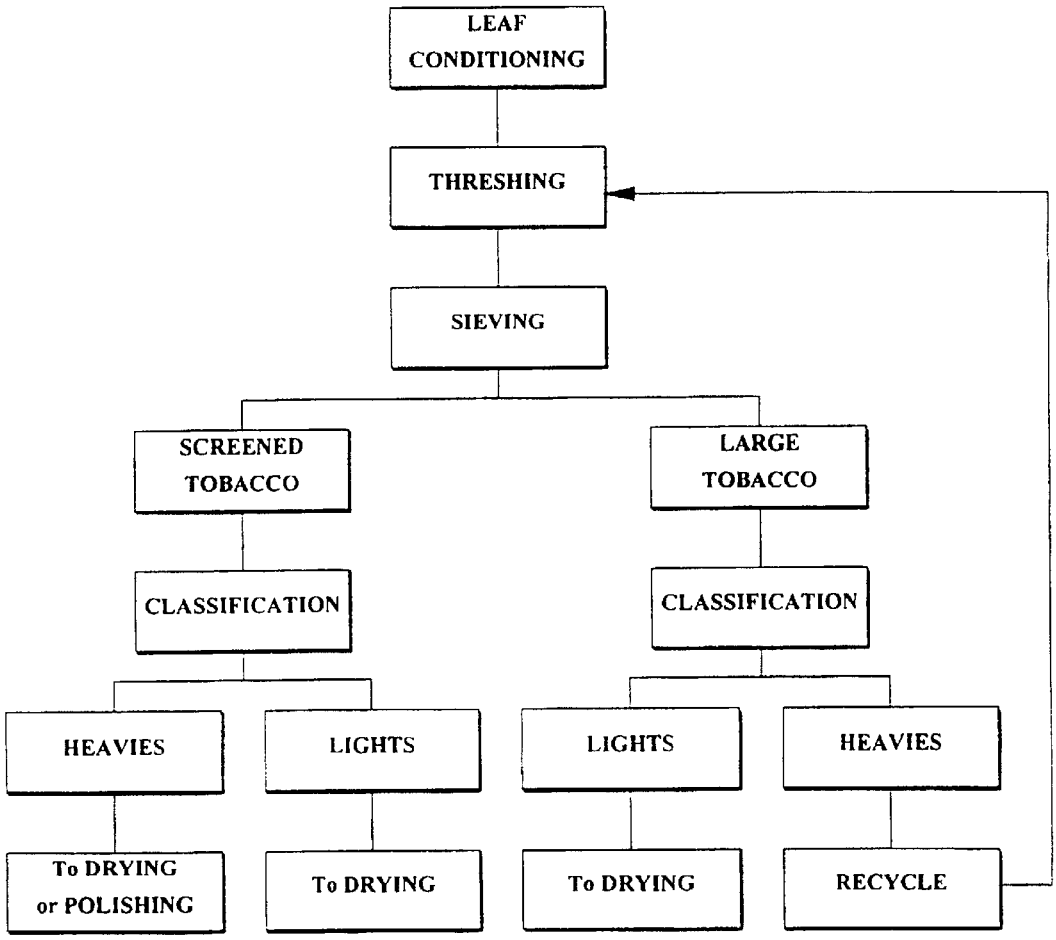
FIG. 2 is a flow diagram showing the process of one embodiment of the invention.

FIG. 2 illustrates the embodiment of the invention in which the mixture of lamina and stem-containing material is separated directly after threshing. Conditioned leaf is threshed and the resulting mixture separated by sieving to provide a screened tobacco fraction and a large tobacco fraction. The sieving causes the stem pieces from which lamina has been completely or substantially completely removed (i.e., the clean or nearly clean stems) to pass through into the screened tobacco with the stem pieces which have relatively large pieces of lamina attached thereto (i.e., the unclean stems) remaining with the large tobacco. Both of the tobacco fractions are treated by air classification and the "lights" (i.e., the lighter material) are sent for drying or further processing. The "heavies" (i.e., the heavier material) from the screened tobacco, which include the clean or nearly clean stem pieces, are sent for drying or further processing, optionally after polishing. The "heavies" from the large tobacco fraction contain the unclean stem pieces with relatively large pieces of lamina attached thereto and are recycled for further threshing. Thus, recycling is made possible by separating out the clean stem pieces.

Figure 3:
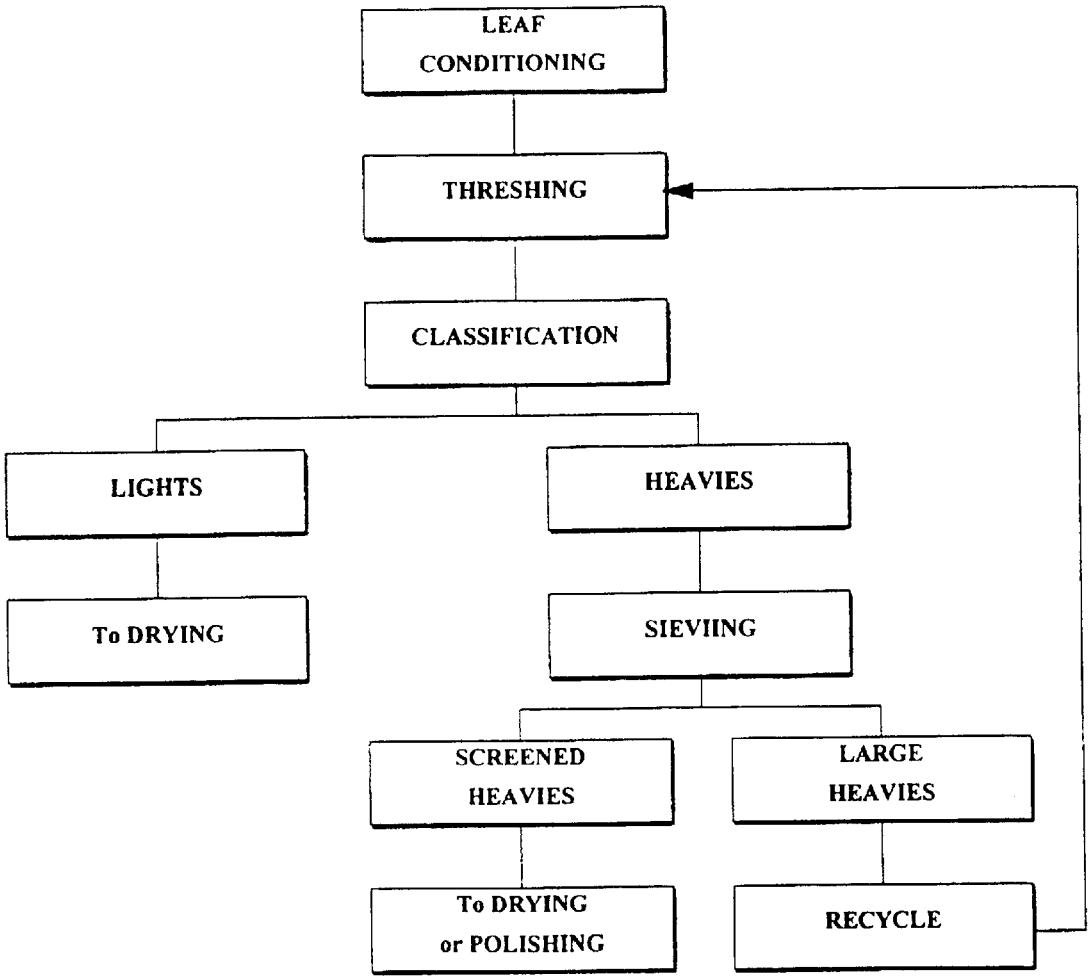
FIG. 3 is a flow diagram showing the process of another embodiment of the invention.

FIG. 3 illustrates another embodiment of the invention in which the separation of the clean or nearly clean stem material is carried out after air separation of the threshed mixture. The tobacco leaf is conditioned, threshed and treated by air separation to obtain "lights" and "heavies" fractions. The "lights" fraction contains chiefly free lamina and the "heavies" fraction includes the stem-containing material. The "lights" are sent for drying or further processing. The "heavies" are separated by sieving to provide a screened heavies fraction and a large heavies fraction. The screened heavies fraction contains clean or nearly clean stem pieces which are dried (optionally after polishing). The large heavies fraction contains unclean stem pieces which have relatively large pieces of lamina still attached and are recycled to the threshing process for removal of these pieces of lamina.

Figure 4:
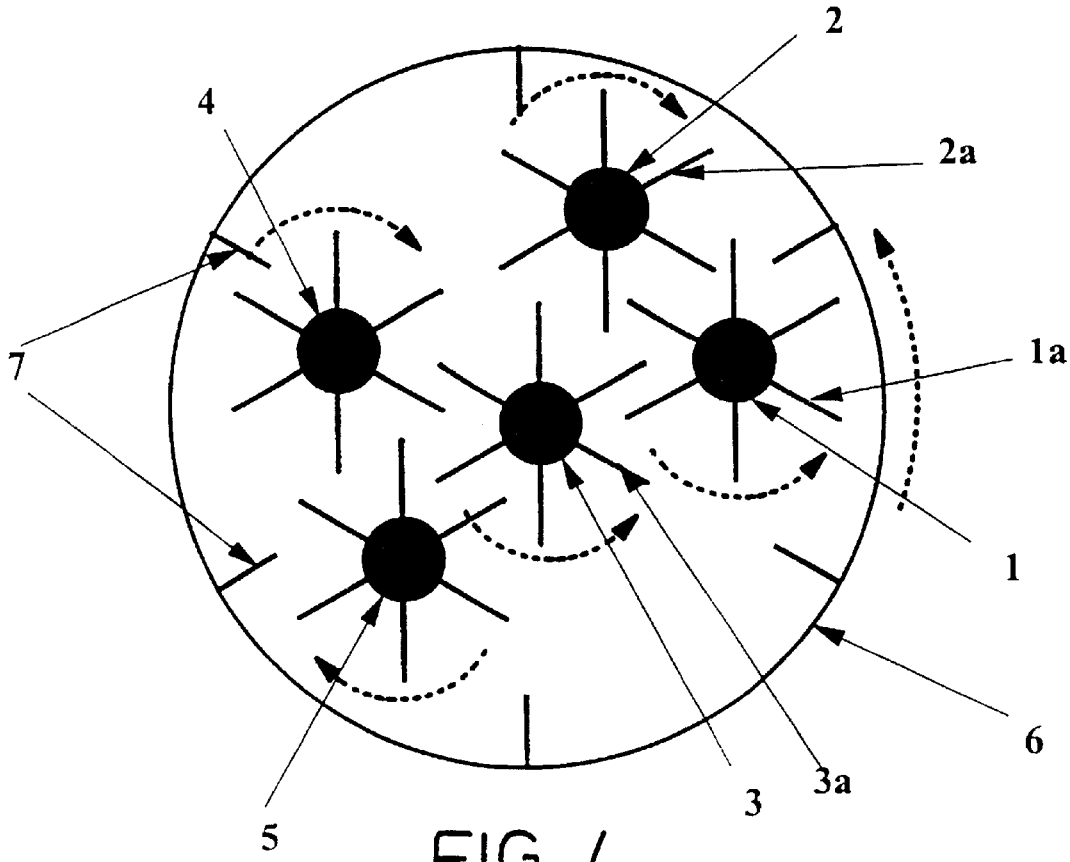
FIG. 4 shows a cross-section through a threshing and sifting device-for use in a preferred embodiment of the apparatus of the invention.
Figure 8:
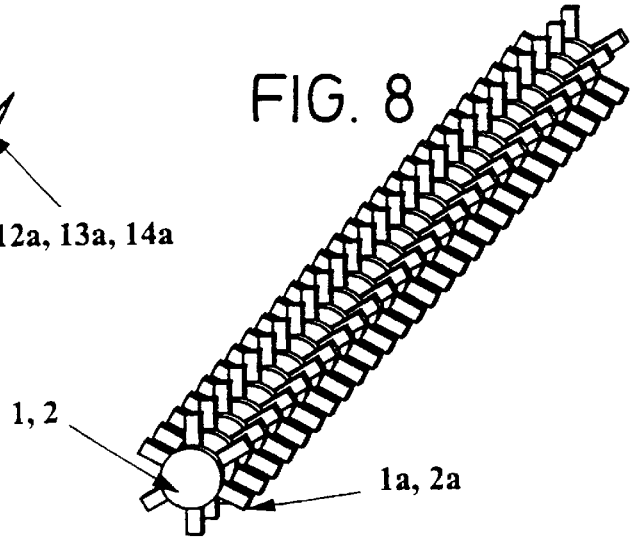

Referring to FIG. 4, drum 6 rotates about a substantially horizontal axis in an anti-clockwise direction. A series of lifting pins (or lugs) 7 are attached to the inside surface of drum 6. The function of the pins 7 is to move the tobacco leaves up the side of drum 6. The leaves are then gathered by co-operating counter-rotating elements 1 and 2 which form a feeder for the leaves. Elements 1, 2 comprise radially extending arms 1*a*, 2*a* which run the full length of the drum. In the embodiment of the invention shown in FIG. 4, the arms 1*a*, 2*a* are as depicted in FIG. 8. The leaves are forced between elements 1, 2 where some of the shearing or cutting of the leaves may take place. The leaves are delivered from between elements 1, 2 into stripping means 3 which has arms 3*a*. Stripping means 3 rotates in the same direction as the drum in the Figure, i.e., anti-clockwise, although it may rotate in the opposite direction. It is in the region of delivery of the leaves from elements 1, 2 to arms 3*a* of stripping means 3 that the major part of the threshing takes place as the leaves which are still partially held by elements 1, 2 are torn by the shearing action of stripping means 3. Stripping means 3 may also act to cut the leaves to some extent. The leaves threshed by stripping means 3, excluding any parts of the threshed leaf which may have fallen to the bottom of drum 6, are gathered between stripping means 3 and element 4 which is located further round the drum 6 (in the direction of its rotation) and are forced towards second stripping means 5 creating a second shearing zone within the drum. The rotational direction of the rotating elements 1, 2, 4, the stripping means 3, 5 and the drum 6 are indicated by the broken arrows.

Figure 5:
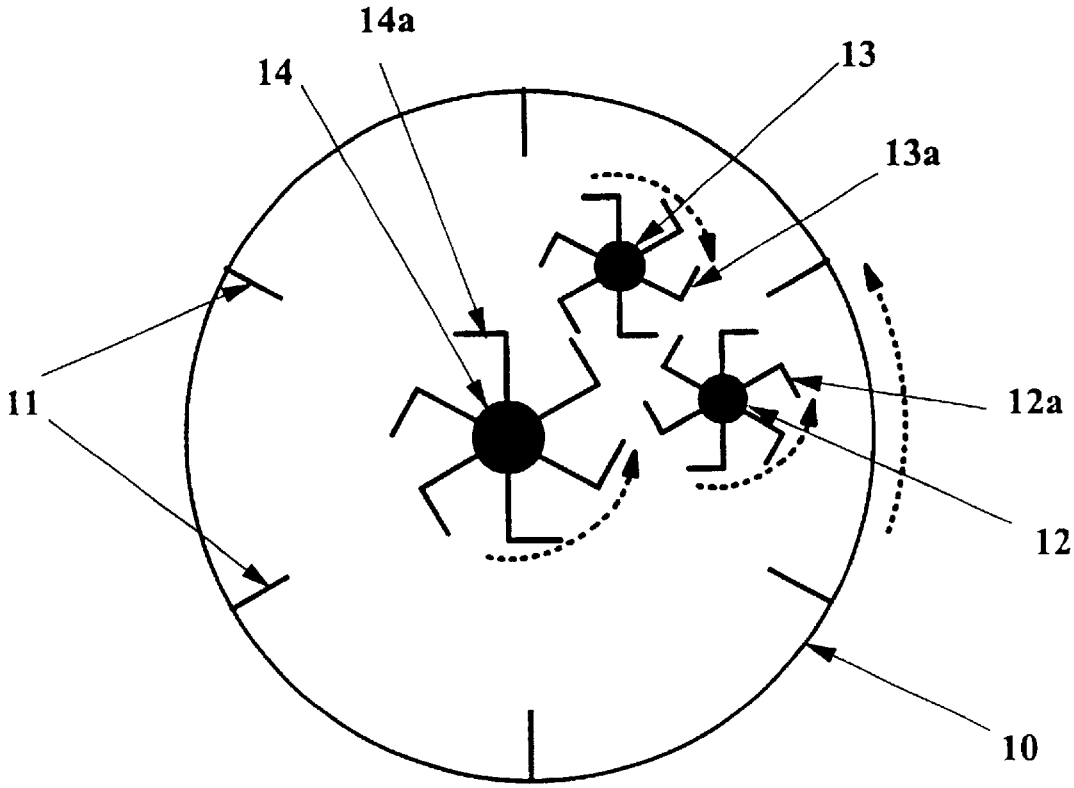
FIG. 5 shows a cross-section through a device for use in another preferred embodiment of the apparatus of the invention.
Figure 7:
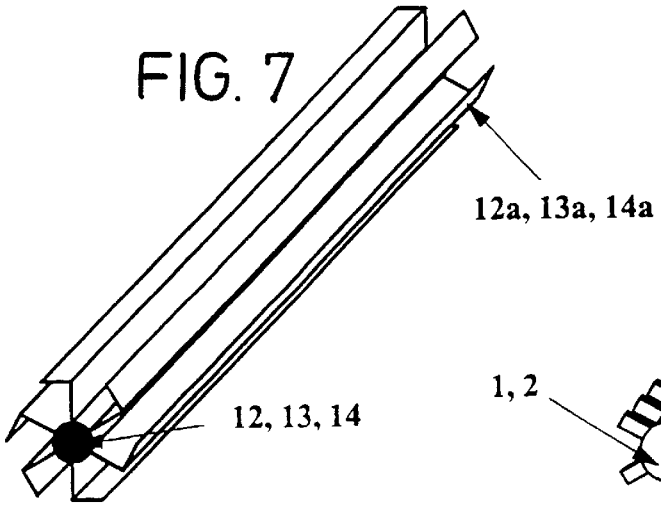
FIGS. 7 and 8 show perspective views of stripping means suitable for use in the threshing and sifting device.
Figure 10:
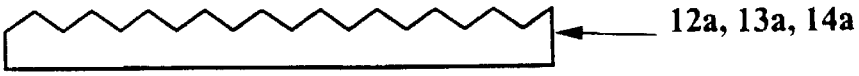
FIG. 10 shows a cross-sectional view of another stripping means for use in the threshing and sifting device.
Figure 11:
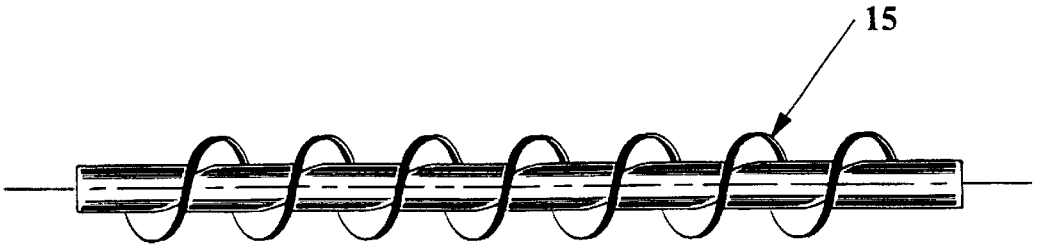
FIG. 11 is a side view of yet another stripping means suitable for use in the threshing and sifting device.

Another embodiment of the device is illustrated in FIG. 5. Here the leaves are carried up the side of the drum 10 on the lugs 11 by the rotational movement of the drum 10 (anti-clockwise in the Figure). The leaves are then drawn into the gap between the counter-rotating elements 12 and 13 which run the length of the drum 10 and co-operate to act as a feeder which directs the leaves into stripping means 14. The main function of stripping means 14 is to shear or rip the lamina free from the stems of the leaves. Stripping means 14 and elements 12, 13 have bent arms 14*a*, 12*a*, 13*a* and are of the general design shown in FIG. 7. An alternative design for the arms 14*a*, 12*a*, 13*a* is illustrated in FIG. 10.

Figure 6:
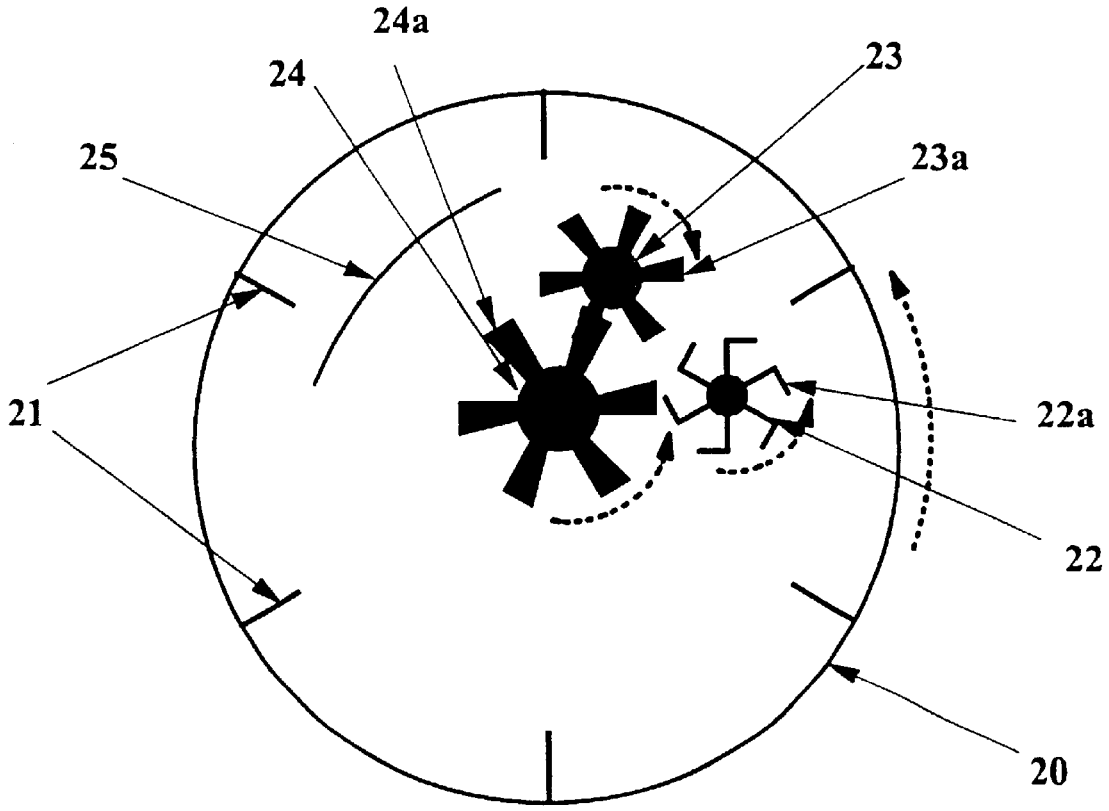
FIG. 6 shows a cross-section through another threshing and sifting device for use in the invention.

In FIG. 6, drum 20 rotates anti-clockwise and, in use, lugs 21 transfer tobacco leaves to counter-rotating elements 22 and 23. The differently designed arms 22*a* and 23*a* of elements 22 and 23, respectively, feed the leaves to stripping means 24 which has arms 24*a*. Arms 24*a* intermesh with arms 23*a*. Fixed element 25 catches the threshed tobacco as it leaves stripping means 24 and allows it to fall back down to the inside surface of drum 20.

Figure 9:
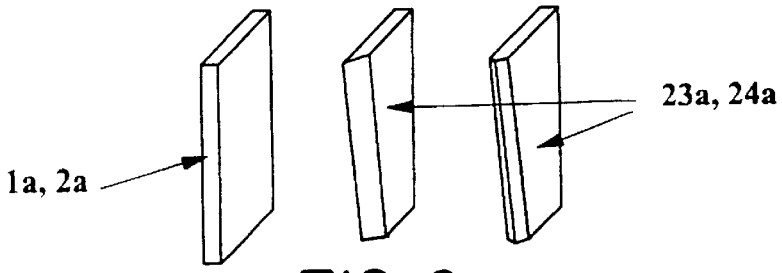
FIG. 9 shows perspective views of three types of arm and/or teeth for use in the threshing and sifting device.

In FIG. 9, the arms 1*a*, 2*a* of the feeder and/or the stripping means may have a flat edge. Alternatively, as shown for arms 23*a*, 24*a*, the outermost edge of the arms may be tapered to a point and may taper from one end to a narrower other end along the drum direction in order to assist in the shearing of the leaves.

The device may be run continuously or in a batch process. For continuous operation, the tobacco leaves are fed into one end of the drum, the leaves are threshed throughout the length of the drum and the threshed leaves which have not already passed out of the drum (e.g., through screens in its walls) exit the drum at the other end. Passage of the leaves from one end of the drum to the other can be achieved by tilting the drum and, optionally, also the rotating components of the apparatus at an angle to the horizontal or by including a helical screw 15 in the apparatus, as shown in FIG. 9. The helical screw can constitute the stripping means and/or the rotating elements of the apparatus.

Alternatively, the transfer of the leaf material down the drum can be effected by arranging the lugs helically on the inside of the drum or the transfer can be caused by air currents acting on the leaf material.

To assist transfer through the drum, an additional fixed or rotating element, running down the drum parallel to the stripping means, may be used to slow down the tobacco leaving the stripping means. The tobacco thus slowed will then be able to fall under the influence of gravity onto a lower portion of the surface of the drum. Preferably the tangential speed of the additional rotating element is similar to that of the drum (i.e., ±50% of the speed of the drum) and it is also preferred that the additional rotating element has a direction of rotation opposite to that of the drum.

Figure 12:
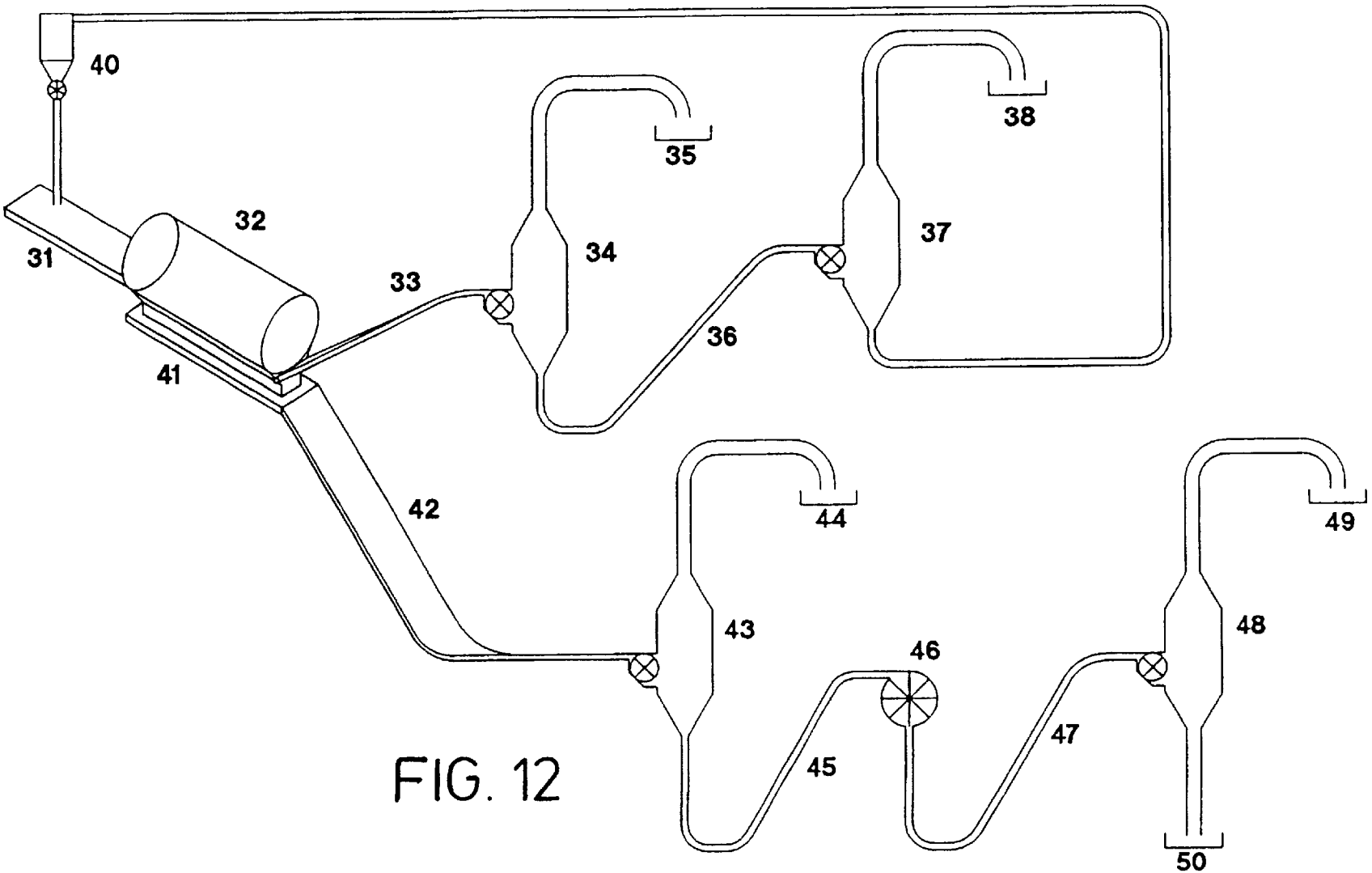
FIG. 12 is a schematic representation of a preferred embodiment of the process of the invention.

Referring to FIG. 12, fresh conditioned tobacco is fed via conveyer 31 into the threshing/sifting device 32. The threshed tobacco which contains the unclean stems and free lamina too large to pass through the sifting screens is conveyed via 33 to the classifiers system, 34, 36 and 37, the light free lamina is collected at collection points 35 and 38, the unclean stems are recycled, via 39 and 40, back onto conveyer 31 and refed to the threshing/sifting machine 32. The clean stems and free lamina which is small enough to pass through the sifting screens are collected on conveyer 41 and transferred via 42, to classifier 43. The light free lamina is collected at 44, and the clean stems are conveyed, via 45, to polishing thresher 46, the polished stems and remaining free lamina are conveyed, via 47, to classifier 48, where the remaining light lamina is collected at 49, and the heavy polished stems are collected at 50.

The threshing/sifting device 32 shown in FIG. 12 can be replaced by a conventional thresher and sieve operating together.

The apparatus shown in FIG. 12 can be reduced by replacing threshing/sifting device 32 by a conventional thresher, removing items 41 to 45, introducing a sieve after classifier 37 after which unclean stems are recycled via 39 and the clean stems conveyed to polishing thresher 46.

The following non-limiting example illustrates the invention.

EXAMPLE

Using apparatus illustrated in FIG. 5 with stripping elements as shown in FIG. 10 with a 50 mm mesh fitted as the drum screen, samples of whole leaf tobacco were processed in batches. Each sample after the first included the recycled material from the previous sample. In this way it was possible to mimic the effects of continuous processing. By the fourth sample a steady state condition had been reached i.e., the mass of material leaving the process was equal to the mass of new material entering the process. The mass of the recycle was 83% of the mass of the new material entering the process. The tobacco passing through the screen was classified and the heavy stem containing portion was polished in a conventional thresher fitted with a 20 mm diameter, round hole, basket. The recovered lamina from the thresher was 5.9% of the total lamina recovered. The total lamina recovered from the process contained 84.4% greater than 12.7 mm and 5.1% less than 6.4 mm.

What is claimed is:

1. A method for processing tobacco comprising:

threshing tobacco leaves in a thresher to form a mixture of free lamina, clean stem pieces from which lamina have been completely or substantially completely removed and unclean stem pieces which have useful pieces of lamina attached thereto;

removing the free lamina from the mixture;

sifting the mixture of clean stem pieces and unclean stem pieces to separate the clean stem pieces from the unclean stem pieces; and subjecting the unclean stem pieces to further threshing by recycling the unclean stem pieces to the thresher.

2. The method according to claim 1 wherein the lamina is removed from the mixture by air classification.

3. A method for processing tobacco comprising:

threshing tobacco leaves in a thresher to form a mixture of free lamina, clean stem pieces from which lamina have been completely or substantially completely removed and unclean stem pieces which have useful pieces of lamina attached thereto;

sifting to separate the clean stem pieces from the unclean stem pieces; and subjecting the unclean stem pieces to further threshing by recycling the unclean stem pieces to the thresher, wherein the threshing and the sifting are carried out in a single step.

4. The method according to claim 3 wherein, after the mixture is sifted to separate out the clean stem pieces, the free lamina is removed from the unclean stem pieces.

5. The method according to claim 4 wherein the lamina is removed from the unclean stem pieces by air classification.

6. The method according to claim 2 wherein the threshing and sifting are carried out in a device which comprises rotatable stripping means and a feeder comprising a pair of cooperating counter-rotatable elements for delivering tobacco leaves to the stripping means.

7. An apparatus for processing tobacco comprising: threshing means for threshing tobacco leaves to form a mixture of free lamina, clean stem pieces from which lamina has been completely or substantially completely removed and unclean stem pieces which have useful pieces of lamina attached thereto, the apparatus further comprising means for sifting to separate the clean stem pieces from the unclean stem pieces and means for returning the sifted unclean stem pieces back to the threshing means, wherein threshing and sifting are carried out in a single device.

8. The apparatus according to claim 7 wherein the device comprises rotatable stripping means and a feeder comprising a pair of cooperating counter-rotatable elements for delivering tobacco to the stripping means.

9. The apparatus according to claim 7 wherein the means for sifting comprises a sieve.

10. The apparatus according to claim 7 wherein the means for returning the sifted unclean stem pieces back to the threshing means comprises a conveyor belt.

11. The apparatus according to claim 7 wherein the device comprises rotatable stripping means and a feeder comprising a pair of cooperating counter-rotatable elements for delivering tobacco leaves to the stripping means.

* * * * *